US009289106B1

(12) United States Patent
Stark et al.

(10) Patent No.: US 9,289,106 B1
(45) Date of Patent: Mar. 22, 2016

(54) FLOOR TREATING MACHINE HEAD WITH FLEXIBLE PAD DRIVER

(71) Applicant: DIAMOND PRODUCTIONS LTD., Montreal (CA)

(72) Inventors: Harvey Stark, Montreal (CA); Pavel Ikonomov, Laval (CA)

(73) Assignee: Diamond Productions Ltd., Montreal, Quebec (CA)

( * ) Notice: Subject to any disclaimer, the term of this patent is extended or adjusted under 35 U.S.C. 154(b) by 0 days.

(21) Appl. No.: 14/521,924

(22) Filed: Oct. 23, 2014

(51) Int. Cl.
*E04G 3/00* (2006.01)
*A47L 11/40* (2006.01)

(52) U.S. Cl.
CPC ..... *A47L 11/4069* (2013.01)

(58) Field of Classification Search
CPC ..... A47L 11/4069; A47L 11/4063; A47L 11/4052; A47L 11/4058; A47L 11/4036
USPC ..... 248/274.1, 276.1
See application file for complete search history.

(56) References Cited

U.S. PATENT DOCUMENTS 4,701,970 A * 10/1987 Wilson ..... A47L 11/164 15/230.16
4,715,087 A 12/1987 Todd et al.
5,054,245 A * 10/1991 Coty ..... A47L 11/164 15/98
5,548,860 A * 8/1996 Weltikol ..... A47L 11/16 15/49.1
5,870,791 A 2/1999 Gurstein et al.
7,326,106 B1 * 2/2008 Rogers ..... B24B 7/186 15/49.1
7,377,838 B1 * 5/2008 Van Vliet ..... A47L 11/16 15/49.1
7,563,156 B2 7/2009 Anderson
2004/0082285 A1 * 4/2004 Bohler ..... B24B 7/186 451/359
2008/0078041 A1 * 4/2008 Mitchel ..... A47L 11/305 15/50.3
2011/0300784 A1 12/2011 Tchakarov et al.
2014/0007368 A1 * 1/2014 Larson ..... A47L 11/283 15/256.5
2014/0352086 A1 * 12/2014 Scholten ..... A47L 11/4013 15/21.1
2015/0082562 A1 * 3/2015 Kamada ..... A47L 11/16 15/104.001

* cited by examiner

*Primary Examiner* — Mark Wendell
(74) *Attorney, Agent, or Firm* — Nikolai & Mersereau, P.A.; Thomas J. Nikolai

(57) ABSTRACT

A pad driver for a floor treating machine comprises an annular support plate to which is attached a plurality of resilient spoke members that project radially therefrom. The support plate is shock-mounted to a hub used to couple the pad driver to a floor treating machine drive motor shaft. On the free ends of the resilient spokes are connector plates on which abrasive pads are removably secured.

8 Claims, 3 Drawing Sheets

FLOOR TREATING MACHINE HEAD WITH FLEXIBLE PAD DRIVER

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to floor treating machines such as burnishers, planetary grinders, polishers and floor scrubbers and, more particularly, to the construction of the pad driver used in such machines.

II. Discussion of the Prior Art

Many machines have been devised for grinding, burnishing, polishing and scrubbing concrete or stone floors to remove surface irregularities and to provide the floors with an attractive, usually shiny and even, appearance. The machines generally comprise a wheeled frame supporting an electric motor or a propane-fueled internal combustion engine having a vertically oriented drive shaft that extends through a top surface of a shroud. Beneath the shroud is one or more circular disks on which abrasive pads are affixed. The drive shaft of the motor extends through bearings in the shroud and is connected so as to spin the pad driving disks about vertical axis. See, for example, U.S. Pat. Nos. 4,715,087; 5,870,791; 7,563,156; and Published Application U.S. 2011/0300784. In each of these machines, the pad driver is planar, rigid and rotates about a vertical axis such that the abrasive pad(s) is/are parallel to the floor.

During operation on a newly installed concrete, marble or other stone floor, irregularities, such as low spots, high spots and ripples are often encountered. Because the prior art pad drivers are rigid, they are unable to follow the contour of the floor. This makes it difficult to achieve a smooth, even look to the floor surface and can greatly expand the time a worker needs to achieve a desired appearance.

SUMMARY OF THE INVENTION

The present invention is directed to a new and non-obvious construction of a driver pad for a floor treating machine that comprises a support plate having a central hub member mounted thereon, which is adapted to couple the pad driver to the shaft of a motor. Extending radially from the support plate are a plurality of flexible spokes that have an attachment bracket affixed to the free ends thereof, the attachment brackets adapted to receive abrasive pads thereon. The spokes, being flexible, are able to flex upon engaging unevenness in a floor being grinded, polished and/or burnished so as to reach all highs and lows that may be present on the floor surface.

BRIEF DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views referred to corresponding parts.

DESCRIPTION OF THE PREFERRED EMBODIMENT

Figure 1:
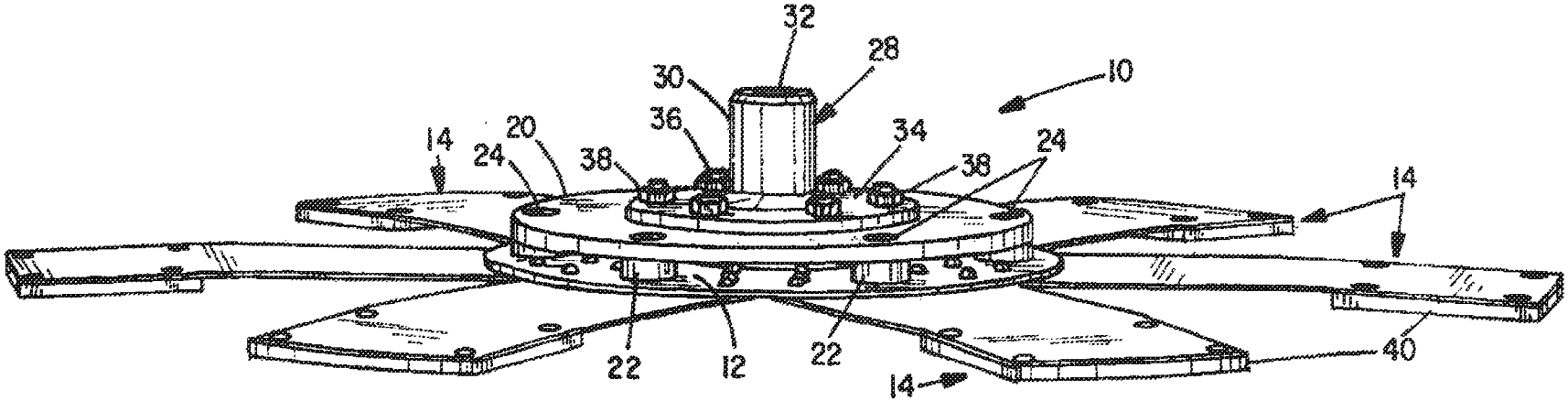
FIG. 1 is a perspective view from the side of the pad driver comprising a preferred embodiment of the present invention.
Figure 2:
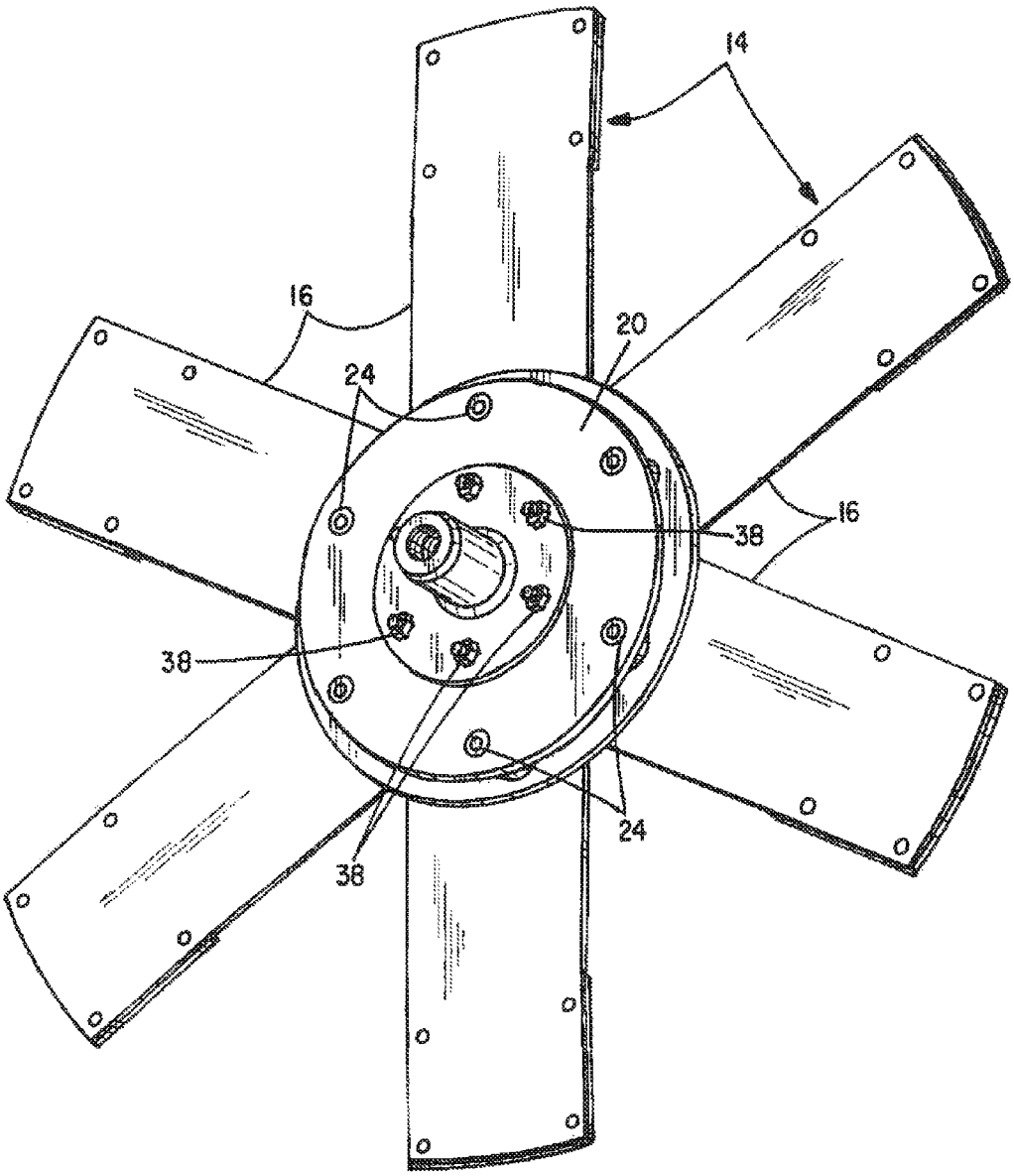
FIG. 2 is a top view thereof.

The description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top", and "bottom", as well as derivatives thereof (e.g., "horizontally", "downwardly", "upwardly", etc.), should be construed to refer to the orientation as then described or as shown in the drawings under discussion. These relative terms are for the convenience of description and do not require that the apparatus be constructed or operated in a particular orientation. Terms, such as "connected", "connecting", "attached", "attaching", "join", and "joining", are used interchangeably and refer to one structure or surface being secured to another structure or surface or integrally fabricated in one piece, unless expressly described otherwise. As used herein, the term "floor treating machine" is meant to include floor grinding, floor polishing, floor burnishing, floor scrubbing and swing machines.

Figure 3:
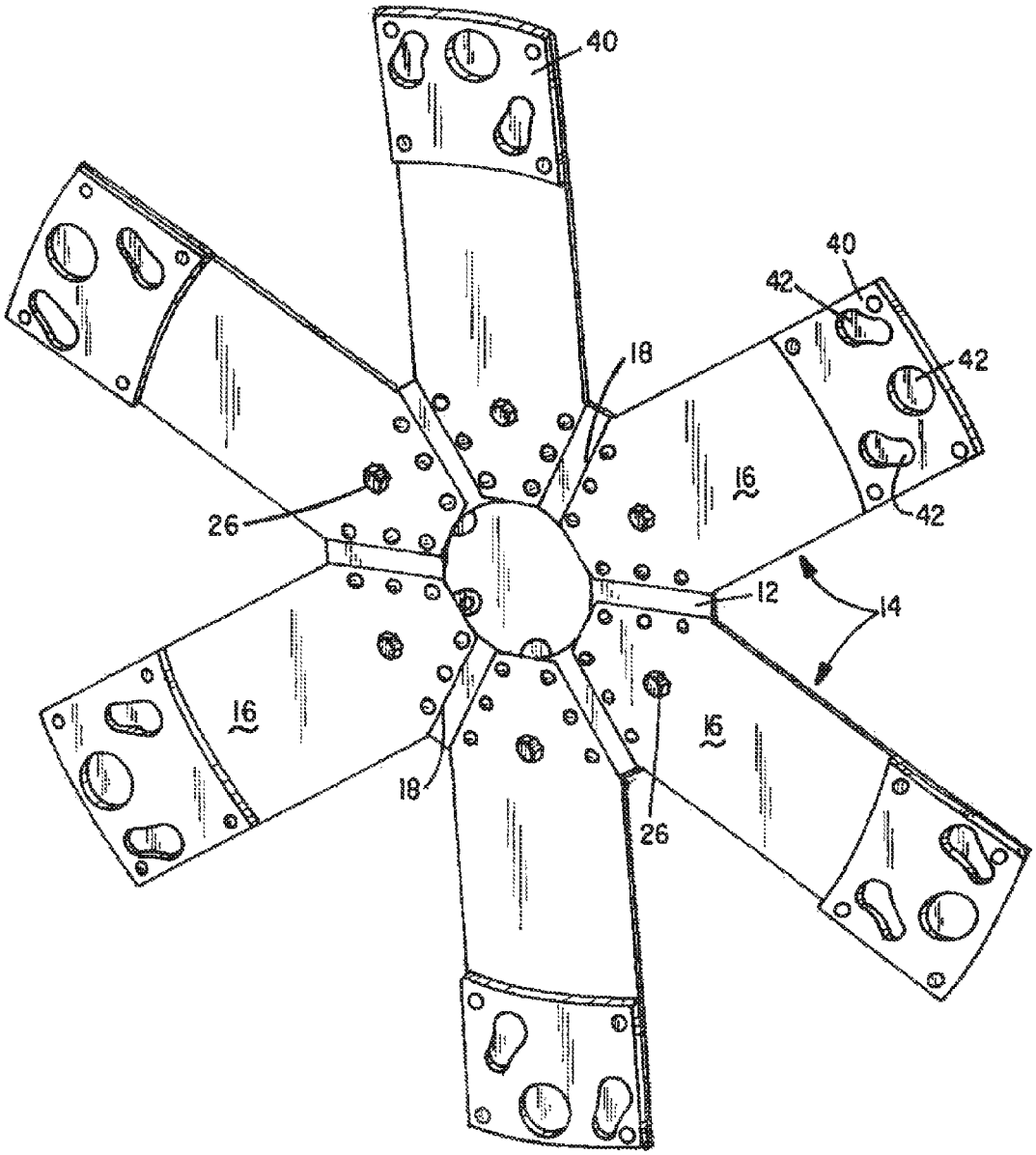
FIG. 3 is a bottom view thereof.

Referring then to FIG. 1, the pad driver for a floor treating machine is indicated generally by numeral 10 and is seen to comprise an annular support plate 12 here shown as a circular disk, which may be steel or aluminum and which has a plurality of resilient spokes 14 radiating therefrom. The embodiment shown in the figures has six such spokes equally radially spaced. As seen in FIG. 3, the spokes 14 are flat planar strips 16, preferably made of spring steel, having tapered inner end portions 18 that are riveted or otherwise fastened to the annular support plate 12.

Centered on the annular support plate 12 is a shock mount member 20 comprising an elastomeric disk 20 preferably exhibiting a durometer in the range of from 40-60 Shore A. The elastomeric disk 20 rests on a plurality of regularly-spaced pedestals or stand-offs 22. Flathead bolts 24 extend through the elastomeric disk 20 and the stand-offs 22, as well as through the thickness dimensions of the annular support plate 12 and the spring steel spokes 16 and are secured with nuts 26 (seen in FIG. 3).

A connector hub 28 is concentrically affixed to the elastomeric disk 20. The hub comprises a tubular stub 30 with a threaded bore 32. The stub projects outward from a surrounding flange 34 which is bolted to the elastomeric disk by through bolts 36 secured by nuts 38.

The hub 28 is adapted to screw onto a threaded shaft of a drive motor (not shown) of the floor treating machine. Affixed to the free ends of the spring steel spokes 14 are connector plates 40 designed to receive and hold removable abrasive pads. The connector plates 40 are preferably similar to what is disclosed in applicant's currently pending U.S. application Ser. No. 14/193,396, filed Feb. 28, 2014, and entitled "Apparatus and Method for Attaching Abrasive Pads to a Drive Plate". The contents of that application are hereby incorporated by reference. In this regard, a plurality of pockets 42 are formed inwardly from a first major surface of the connector plate 40 that incorporate key-hole apertures that are adapted to receive pedestals on the obverse surface of abrasive pads in the manner described in the afore-referenced pending patent application. The connector plates 40 are shown as also being riveted to the free end portions of the spokes 14. While the approach described in the above referenced patent application is preferred, those skilled in the art can appreciate that other known modes of attachment of abrasive pads to drive members can be employed.

As those skilled in the art can appreciate, during a floor treating operation, the pad driver 10 is driven in a generally horizontal plane by a motor coupled to the hub 32 such that abrasive pads affixed to the mounting plates 40 will abrade a floor surface. Because of the ability of the spokes 14 to flex, as any irregularity in the floor surface is encountered, the abrasive pads affixed to the spokes will ride up over the irregularity of the floor. Furthermore, the manner in which the drive plate 12 carrying the spokes 14 and ultimately the abrasive pads affixed to the underside of the connector plates 40 are shock-mounted with respect to the machine's drive motor, the operator is subjected to less vibration via the handle of the machine used to steer it across the floor surface being treated.

While the drawings show flat, spring steel spokes 16, those skilled in the art can appreciate that resiliency can also be achieved by appropriately fabricating the spokes so that they would be capable of flexing when materials other than spring steel, e.g. plastic, are employed.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A pad driver for a floor treating machine comprising:

(a) a support plate;

(b) a plurality of flexible spokes rigidly affixed to and extending radially from the support plate;

(c) a central hub member mounted onto an elastomeric shock mount member that is attached to the support plate in parallel, spaced-apart relation; and (d) connector members affixed to free ends of the plurality of spokes adapted to couple abrasive pads thereto.

2. The pad driver as in claim 1 wherein the shock mount member comprises an elastomeric disk of a durometer in a range from 40 to 60 Shore A.

3. The pad driver as in claim 2 and further including a plurality of tubular elastomeric pedestals disposed between the elastomeric disk and the support plate in surrounding relation to fasteners joining the elastomeric disk to the support plate.

4. The pad driver as in claim 2 wherein the central hub member comprises a tubular stub projecting outward from a surrounding flange, the flange being affixed to the elastomeric disk.

5. The pad driver as in claim 1 wherein the spokes comprise flat sheets of spring steel.

6. The pad driver as in claim 1 wherein the spokes are designed to flex upon engaging unevenness in a floor being treated.

7. The pad driver as in claim 1 wherein the flexible spokes are affixed to the support plate by one of rivets, screws and bolts.

8. The pad driver as in claim 1 wherein the central hub member is adapted to interface a drive motor to the pad driver.

* * * * *